US006983250B2

(12) United States Patent
Guedalia et al.

(10) Patent No.: US 6,983,250 B2
(45) Date of Patent: Jan. 3, 2006

(54) METHOD AND SYSTEM FOR ENABLING A USER TO OBTAIN INFORMATION FROM A TEXT-BASED WEB SITE IN AUDIO FORM

(75) Inventors: David Guedalia, Beit Shemesh (IL); Jacob Guedalia, Newton, MA (US)

(73) Assignee: NMS Communications Corporation, Framingham, MA (US)

( * ) Notice: Subject to any disclaimer, the term of this patent is extended or adjusted under 35 U.S.C. 154(b) by 705 days.

(21) Appl. No.: 10/021,760

(22) Filed: Oct. 22, 2001

(65) Prior Publication Data

US 2002/0091524 A1 Jul. 11, 2002

Related U.S. Application Data

(60) Provisional application No. 60/243,244, filed on Oct. 25, 2000.

(51) Int. Cl.
*G10L 13/00* (2006.01)

(52) U.S. Cl. ..... 704/260; 704/270.1

(58) Field of Classification Search ..... 704/270, 704/270.1, 260

See application file for complete search history.

(56) References Cited

U.S. PATENT DOCUMENTS

| | | | | |
|---|---|---|---|---|
| 6,076,060 | A * | 6/2000 | Lin et al. | 704/260 |
| 6,141,642 | A * | 10/2000 | Oh | 704/260 |
| 6,219,694 | B1 | 4/2001 | Lazaridis et al. | |
| 6,321,226 | B1 * | 11/2001 | Garber et al. | 707/10 |
| 6,466,654 | B1 * | 10/2002 | Cooper et al. | 379/88.01 |
| 6,546,082 | B1 * | 4/2003 | Alcendor et al. | 379/52 |
| 6,707,889 | B1 * | 3/2004 | Saylor et al. | 379/88.04 |

OTHER PUBLICATIONS

Victor W. Zue "Navigating the Information Superhighway Using Spoken Language Interfaces", IEEE Expert, Oct. 1995, pp. 39-43.

Matthew Lennig, "Putting Speech Recognition to Work in the Telephone Network", IEEE Institute of Electrical and Electronic Engineers, Aug. 1990, pp. 35-41.

Frank Stajano, et al., "The Thinnest of Clients: Controlling It All Via Cellphone", Mobile Computing and Communications Review, vol. 2, No. 4, Oct. 1998.

* cited by examiner

*Primary Examiner*—David D. Knepper
(74) *Attorney, Agent, or Firm*—Chapin & Huang LLC; Barry W. Chapin, Esq.

(57) ABSTRACT

A method and system for automatic conversion of text to speech including automatically analyzing a text to define at least one vocabulary domain and carrying out a text-to-speech conversion by employing said at least one vocabulary domain.

8 Claims, 3 Drawing Sheets

METHOD AND SYSTEM FOR ENABLING A USER TO OBTAIN INFORMATION FROM A TEXT-BASED WEB SITE IN AUDIO FORM

REFERENCE TO RELATED APPLICATIONS

This application claims priority from U.S. Provisional Application Ser. No. 60/243,244 entitled: "A method and system for voice browsing web site" and filed on Oct. 25, 2000.

BACKGROUND OF INVENTION

The advent of the Internet has enabled more rapid publication of a wealth of information to wider audiences than ever before, at significantly lower costs. Over the last ten years tremendous efforts have been made to publish information in HTML, which is easily accessible to anyone with a computer, a web browser and an Internet connection. More recently, the introduction of HDML and the subsequent introduction of WML have enabled mobile users to access published information using hand-held wireless devices.

Wireless browsers have increased access to Internet-published information for a small segment of the population. WAP (Wireless Application Protocol) enabled devices enable users to access web based information instantly via mobile telephones, pagers, two-way radios, smart phones and communicators. Handheld PDAs (Personal Digital Assistants) also enable users to access web based information, usually by first downloading an application file from a relevant web site.

For the large remainder of the population who do not have access to a WAP enabled device or PDA, the introduction of Interactive Voice Response Units (IVR's) connected to the Internet has enabled access to web based information from any telephone.

SUMMARY OF THE INVENTION

Although an IVR may be capable of accessing information that resides on the Internet, there is a lack of methodology to automatically construct audio content from textual format residing on the Internet.

There is thus provided in accordance with a preferred embodiment of the present invention a method for automatic conversion of text to speech including automatically analyzing a text to define at least one vocabulary domain and carrying out a text-to-speech conversion by employing said at least one vocabulary domain.

There is also provided in accordance with a preferred embodiment of the present invention a system for automatic conversion of text to speech, which includes an automatic text analyzer and vocabulary domain definer, automatically analyzing a text to define at least one vocabulary domain and a text-to-speech converter, carrying out a text-to-speech conversion by employing said at least one vocabulary domain.

Further in accordance with a preferred embodiment of the present invention the step of automatically analyzing includes utilizing a closeness metric for defining said at least one vocabulary domain. Preferably, the closeness metric is a content-based metric.

Still further in accordance with a preferred embodiment of the present invention the method also includes transmitting speech resulting from said text-to-speech conversion over a telephone link.

Additionally in accordance with a preferred embodiment of the present invention the step of automatically analyzing text comprises analyzing a text published on a web site.

Additionally or alternatively, the step of automatically analyzing text comprises generating speech recognition grammar.

Further in accordance with a preferred embodiment of the present invention the stop of automatically analyzing text comprises comparing a newly defined vocabulary domain with at least one previously defined vocabulary domain.

Still further in accordance with a preferred embodiment of the present invention the method operates to convert at least one of HDML, HTML and WML format texts to at least one of VXML, and VoiceXML.

Additionally in accordance with a preferred embodiment of the present invention the step of carrying out a text-to-speech conversion employs multiple text-to-speech converters.

Further in accordance with a preferred embodiment of the present invention the system for automatic conversion of text to speech includes multiple text-to-speech converters, at least two of which correspond to at least two different vocabulary domains.

There is further provided in accordance with a preferred embodiment of the present invention a method for automatic conversion of text to speech including the steps of carrying out a text-to-speech conversion by employ multiple text-to-speech converters, at least two of which correspond to at least two different vocabulary domain and carrying out a text-to-speech conversion by employing said at least one vocabulary domain.

BRIEF DESCRIPTION OF THE DRAWINGS

The present invention will be more fully understood and appreciated from the following detailed description, taken in conjunction with the drawings, in which.

DETAILED DESCRIPTION OF A PREFERED EMBODIMENT

The present invention provides a system and methodology for converting and delivering textual information, typically including menus and content, such as Wireless Application Protocol (WAP) enabled information.

In a typical scenario, in accordance with the present invention, a Service Provider may wish to voice-enable textual information, such as local weather or news, for access thereto over the telephone. The process of voice-enabling an existing text based web site preferably comprises the following three steps:

First, the Service Provider specifies the location of the textual information. The Service Provider may connect via a standard web browser to the system of the present invention. The Service Provider may then fill out a form specifying a relevant URL such as an HDML/WML/HTML web site in order to receive textual information such as a weather report.

Next, the Service Provider may receive an acknowledgment page that may contain, among other information, the Service Provider's uniquely assigned Direct Inward Dial (DID) number.

Finally, a subscriber may place a telephone call to the assigned DID number in order to access the system of the present invention. The textual information provided by the Service Provider may then be retrieved and broadcast to the subscriber over the telephone.

Figure 1:
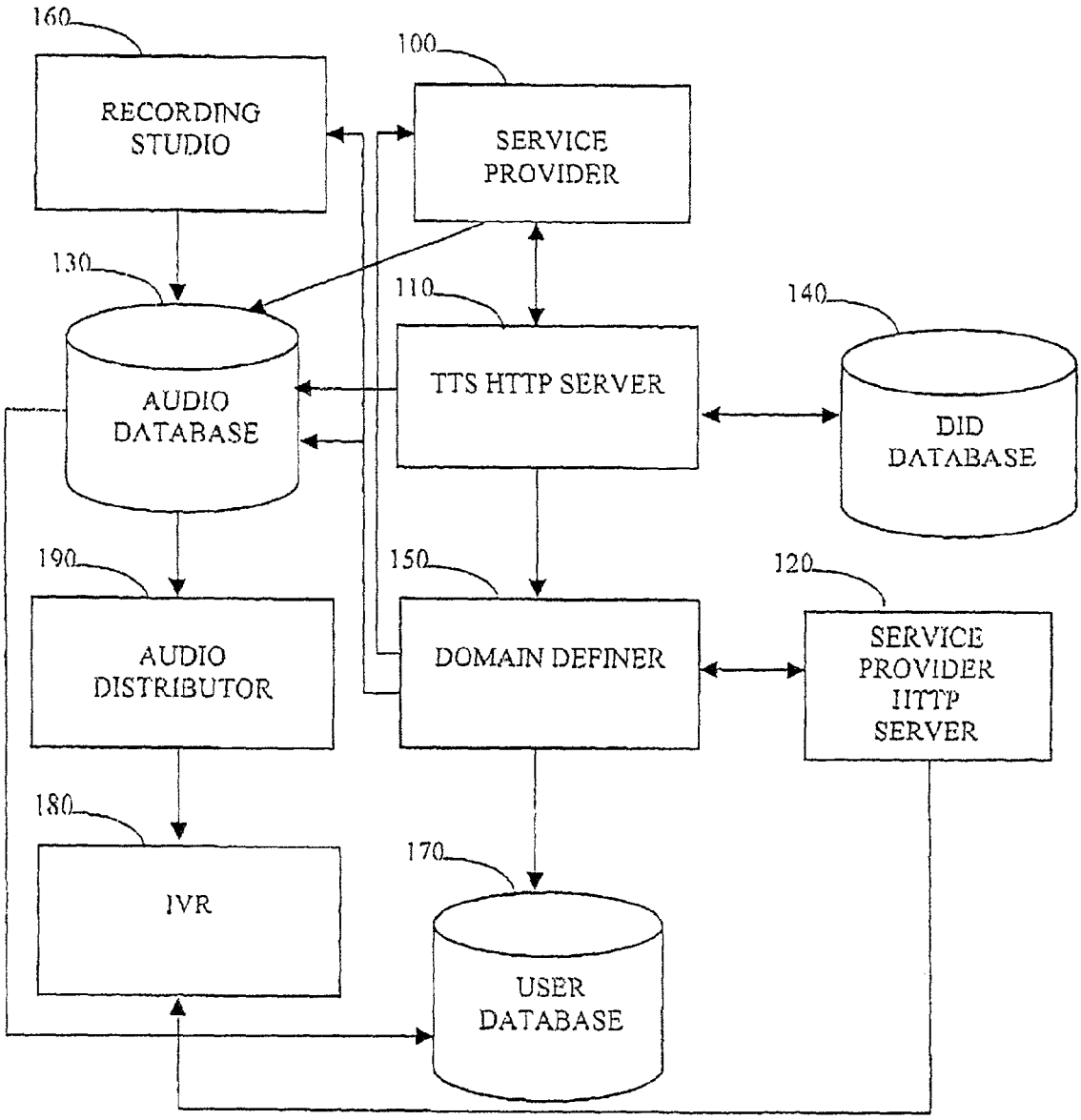
FIG. 1 is a simplified illustration of a method and system for preparation of an existing textual Internet page, for future audio publication.

Reference is now made to FIG. 1, which illustrates a system and methodology for preparation of an existing textual Internet page for future broadcast. A Service Provider 100 may connect to a TTS HTTP server 110 by utilizing a web browser and may retrieve a form. The Service Provider 100 may fill out the form specifying the location of the textual information, typically the URL of an HDML/WML/HTML web site located on a Service Provider HTTP Server 120. Optionally, the Service Provider 100 may also specify audio content that may be placed in an Audio Database 130. Should the Service Provider 100 submit the form to the HTTP Server 110, the TTS HTTP server 110 may connect to a DID Database 140 to retrieve a DID number and may assign it to the Service Provider 100. The TTS HTTP server 110 may return an acknowledgement page to the Service Provider 100 that may contain, among other information, the DID number assigned to the Service Provider 100.

The TTS HTTP server 110 may forward the location of the textual information, typically the URL, to an Analyzer/Vocabulary Domain Definer 150 to be analyzed. The Analyzer/Vocabulary Domain Definer 150 may connect to the Service Provider HTTP Server 120 and request the URL. The Analyzer/Vocabulary Domain Definer 150 may then span the various HDML/WML/HTML pages found on the Service Provider HTTP Server 120, following hyperlinks and collecting the vocabulary of the textual information published thereon.

The Analyzer/Vocabulary Domain Definer 150 may further analyze the assembled vocabulary to determine a lexicon and vocabulary domains represented thereby. A web site may contain text that can be grouped into different limited vocabulary domains, in which each limited domain contains a cluster of textual information including at least partially similar vocabularies. For example, the Analyzer/Vocabulary Domain Definer 150 may group sentences that share one or more selected words into the same limited vocabulary domain. Thus, for example, all published textual information regarding "weather" may be placed into a single limited vocabulary domain. Similarly, all queries such as forms regarding "city-state information" or "customer information" may define different limited vocabulary domains.

Once the textual information has been clustered into its respective limited vocabulary domains, similar textual information received in the future may be mapped to respective clusters within appropriate vocabulary domains.

The Analyzer/Vocabulary Domain Definer 150 may compare the vocabulary domains required to represent the textual information of the web site with existing recorded audio, stored in the Audio Database 130. Should the Analyzer/Vocabulary Domain Definer 150 determine the need to record new audio files, the Analyzer/Vocabulary Domain Definer 150 may send a request to a Recording Studio 160 with the sentences or words to be recorded. The Recording Studio 160 provides the Audio Database 130 with the sentences and/or words recorded. The complete set of formatting configuration information necessary to format the textual web site for audio publication may be stored for later retrieval in a User Database 170. At the time of such retrieval, as described in more detail in FIG. 2, an IVR 180 may access the textual information on the Service Provider HTTP Server 120 and may convert the textual information to audio on the fly, by utilizing the User Database 170.

Optionally, if the Service Provider 100 specifies audio content, an Audio Distributor 190 may distribute specified audio files to one or more IVRs 180. In this situation each IVR 180 may access specified audio files locally, such as from the IVR's hard drive.

Figure 2:
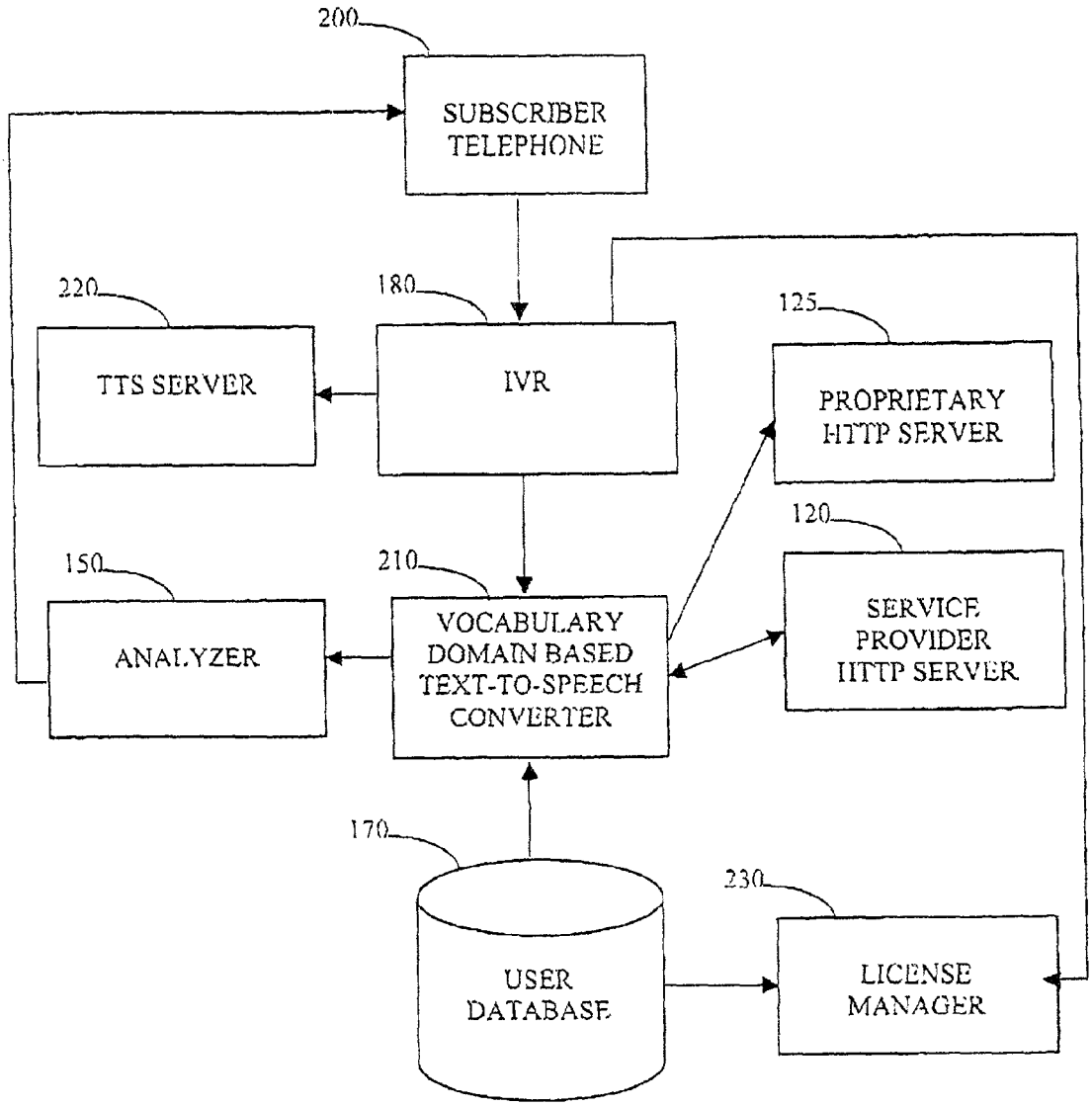
FIG. 2 is a simplified illustration of a method and system for audio publication of textual information on a web site.

Reference is now made to FIG. 2, which illustrates a method and system employed during retrieval to format a textual web site for audio publication. A Subscriber 200, typically employing a telephone, communicates with an IVR 180. The IVR 180 may be employed to access textual information published on the Service Provider HTTP Server 120. This may be accomplished either by the Subscriber 200 explicitly specifying the textual information. Alternatively, the IVR 180 may detect the preferences of the Subscriber 200 either through Dialed Number Identification Service (DNIS) or Automatic Number Identification (ANI)

Next, the IVR 180 may request to retrieve the textual information from a Vocabulary Domain Based Text-to-Speech Converter 210. The Vocabulary Domain Based Text-to-Speech Converter 210 may connect to the Service Provider HTTP Server 120 and may request the textual information. The Service Provider HTTP Server 120 may transmit the textual information, such as HDML/WML/HTML information to the Vocabulary Domain Based Text-to-Speech Converter 210. The Vocabulary Domain Based Text-to-Speech Converter 210 may also retrieve the previously defined formatting configuration information from the User Database 170, and employ the formatting configuration information to convert the textual information retrieved from Service Provider HTTP Server 120 into a mark up language that the IVR 180 may process, such as VoiceXML®.

During the process of conversion, the Vocabulary Domain Based Text-to-Speech Converter 210 may further utilize the formatting configuration information to insure that the IVR 180 will make efficient use of a Text to Speech Server (TTS) 220. This may be accomplished through mapping the text to clusters, previously defined in a preparatory stage described hereinabove with reference to FIG. 1. Should the Vocabulary Domain Based Text-to-Speech Converter 210 fail to map or parse the textual information, for example should the textual information on the Service Provider HTTP Server 120 have changed dramatically from a previous communication with the web site, the Vocabulary Domain Based Text-to-Speech Converter 210 preferably notifies the Analyzer/Vocabulary Domain Definer 150 (FIG. 1). The Analyzer/Vocabulary Domain Definer 150, upon receiving a notification of changed textual information on the web site, may analyze the web site as previously described in the preparatory phase described hereinabove with reference to Fig. and transfer the new textual information to the Audio Database 130 and/or to the Recording Studio 160. Additionally the Analyzer/Vocabulary Domain Definer 150 may send an email notification to the Service Provider 100 (FIG. 1).

While providing service to the Subscriber 200, the IVR 180 may remain in contact with a License Manager 230 throughout. The License Manager 230 is responsible for ensuring that subscribers are billed in accordance with usage. The License Manager 230 may retrieve subscriber configuration information from the User Database 170 and monitor subscriber usage. This methodology enables the IVR 180 to interrupt the Subscriber 200, should the License Manager 230 determine that subscriber 200 has exceeded any previously specified limits set by the Service Provider 100 (FIG. 1), such as pre-paid calling time limits.

Optionally, the Service Provider 100 (FIG. 1) may configure the textual information residing on the Service Provider HTTP Server 120 to incorporate a proprietary API (not shown) that may enable the Vocabulary Domain Based Text-to-Speech Converter 210 to fully utilize the mark-up language. For instance, the Service Provider 100 may possess pre-recorded audio that resides on a Proprietary HTTP Server 125, that describes the current news in Pakistan. When the Subscriber 200 communicates to the IVR 180, the IVR 180 may determine that the Subscriber 200 is calling from Pakistan. This information may be used to specify the consumer's location to the Proprietary HTTP Server 125. Based on this information, the Service Provider HTTP Server 120 may be able to utilize corresponding proprietary features on Vocabulary Domain Based Text-to-Speech Converter 210 to enable the IVR 180 to retrieve the audio file, which may contain the latest news stories for Pakistan from the Proprietary HTTP server 125.

Figure 3:
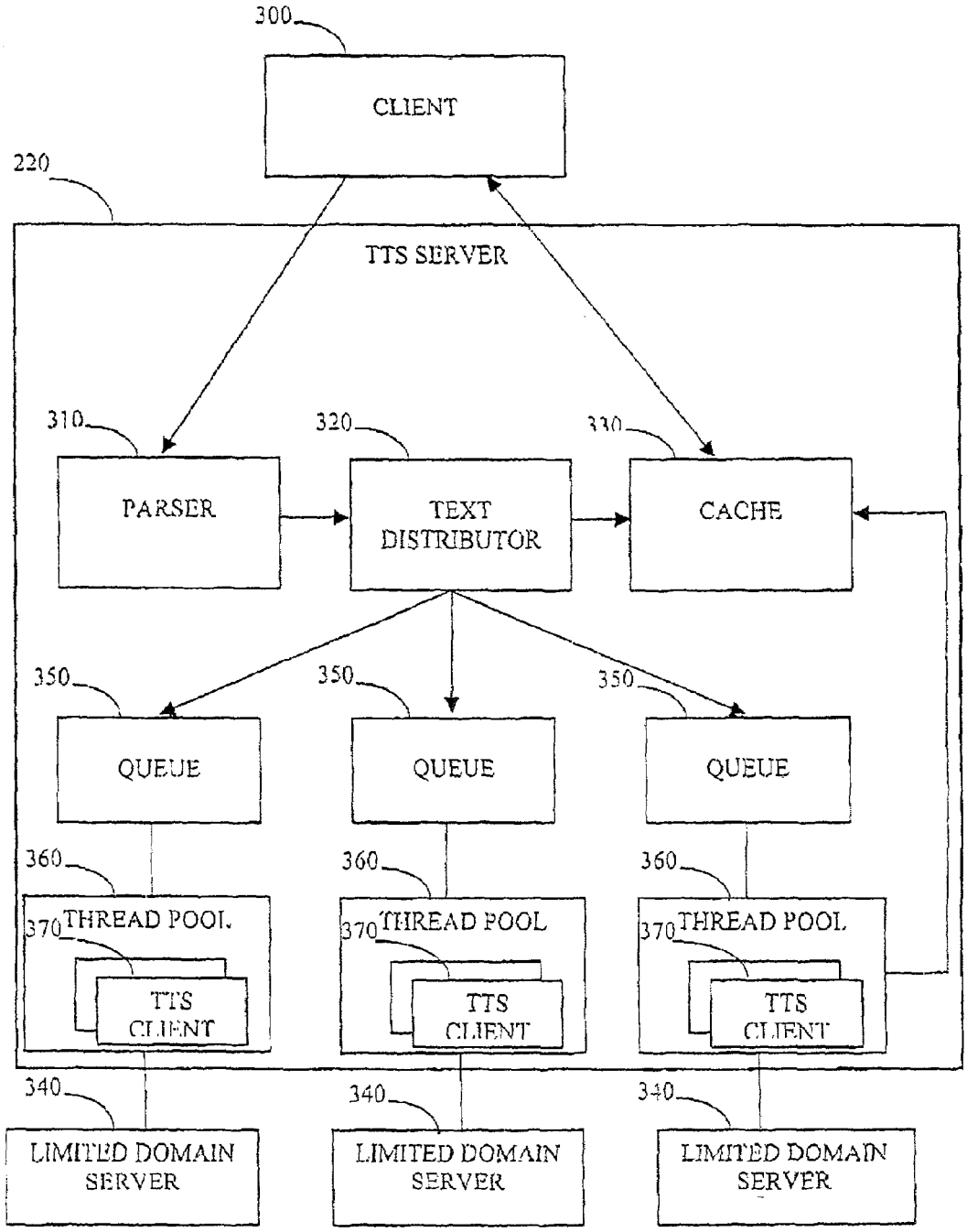
FIG. 3 is a simplified illustration of the function and operation of one embodiment of a text-to-speech server forming part of the embodiment of FIG. 2.

Reference is now made to FIG. 3, which depicts an efficient mechanism for providing vocabulary domain text-to-speech services. A Client 300 preferably sends textual information to the TTS Server 220 to be processed. A Parser 310, located within the TTS server 220, preferably receives the textual information and parses the text into phrases. A Text Distributor 320, also located within the TTS server 220, preferably first checks with a Cache 330, located within the TTS server 220, to determine whether the phrases have been previously cached. If so, the Cache 330 may return the audio content back to the Client 300. Otherwise, the Text Distributor 320 may map phrases to their respective clusters, which may have been previously defined by the Analyzer/Vocabulary Domain Definer 150 (FIGS. 1 and 2).

Each cluster may be associated with a representative Limited Vocabulary Domain Server 340. The Text Distributor 320 may enqueue the phrases on one of a plurality of Queues 350, each associated with the respective limited vocabulary domain. Each Queue 350 may have associated therewith a Thread Pool 360 and a TTS Client 370 to facilitate distributed concurrent processing of requests.

When the Text Distributor 320 enqueues a phrase on a particular Queue 350, the relevant Queue 350 may notify the Thread Pool 360 of the new phrase. Should the Thread Pool 360 have a free thread, the Thread Pool 360 may dequeue the phrase from the Queue 350 and may communicate the phrase to the TTS Client 370. The TTS Client 370 may further transmit the phrase to the relevant Limited Vocabulary Domain Server 340. The Limited Vocabulary Domain Server 340 is preferably defined to have a limited vocabulary domain and to be capable of suitably processing the phrase and converting the phrase to audio content. The phrase may be stored in the Cache 330 for future reference and may be transmitted back to the Client 300.

It will be appreciated by persons skilled in the art that the present invention is not limited by what has been particularly shown and described hereinabove. Rather the present invention includes combinations and sub-combinations of the various features described hereinabove as well as modifications and extensions thereof, which would occur to a person skilled in the art and which do not fall within the prior art.

What is claimed is:

1. A method of enabling a user to obtain information from a text-based web site in audio form, comprising:

A. in a first operation to prepare the text-based web site for delivery in audio form:

(i) accessing content of a text-based web site to collect a vocabulary of textual information appearing therein;

(ii) analyzing the collected vocabulary to determine a plurality of limited vocabulary domains into which the textual information of the web site can be grouped, the textual information of each limited vocabulary domain sharing a content-based closeness metric;

(iii) comparing the limited vocabulary domains with existing recorded audio content to determine whether additional audio content is necessary to deliver the web site in audio form, and if so then obtaining such additional audio content; and (iv) storing formatting configuration information specifying how to deliver the text-based web site in audio format according to the limited vocabulary domains using the existing and additional audio content; and B. in a second operation performed upon a user's request for audio delivery of textual information from the text-based web site:

(i) obtaining the requested textual information from the text-based web site and parsing the textual information into phrases;

(ii) based on the stored formatting configuration information, mapping the parsed phrases to respective ones of the vocabulary domains and providing each parsed phrase to a corresponding limited vocabulary domain server capable of converting the parsed phrase to an audio component;

(iii) receiving audio components from the limited vocabulary domain servers, the audio component resulting from the conversion of the parsed phrases by the limited vocabulary domain servers; and (iv) generating audio to the user based on the audio components received from the limited vocabulary domain servers.

2. A method according to claim 1, wherein the content-based closeness metric shared by the textual information of each limited vocabulary domain includes sharing one or more selected words.

3. A method according to claim 1, further comprising:

maintaining a cache of the audio components from the limited vocabulary domain servers; and prior to providing the parsed phrases to the limited vocabulary domain servers, checking whether audio components for the parsed phrases are present in the cache;

and wherein (i) a given parsed phrase is provided to the corresponding limited vocabulary domain server only if the audio component for the given parsed phrase is not present in the cache, and (ii) the audio is generated to the user based on the audio components from the cache if present therein.

4. A method according to claim 1, wherein the text-based web site includes special audio components to be made available to users satisfying a predetermined criteria, and further comprising:

determining whether the user satisfies the predetermined criteria; and if the user is determined to satisfy the predetermined criteria, then retrieving the special audio components and generating special audio to the user based on the retrieved audio components.

5. A system for enabling a user to obtain information from a text-based web site in audio form, comprising:

A. an analyzer and vocabulary domain definer operative perform a first operation to prepare the text-based web site for delivery in audio form, the first operation including:

(i) accessing content of a text-based web site to collect a vocabulary of textual information appearing therein;

(ii) analyzing the collected vocabulary to determine a plurality of limited vocabulary domains into which the textual information of the web site can be grouped, the textual information of each limited vocabulary domain sharing a content-based closeness metric;

(iii) comparing the limited vocabulary domains with existing recorded audio content to determine whether additional audio content is necessary to deliver the web site in audio form, and if so then obtaining such additional audio content; and (iv) storing formatting configuration information specifying how to deliver the text-based web site in audio format according to the limited vocabulary domains using the existing and additional audio content; and B. text-to-speech converter apparatus operative to perform a second operation upon a user's request for audio delivery of textual information from the text-based web site, the second operation including:

(i) obtaining the requested textual information from the text-based web site and parse the textual information into phrases;

(ii) based on the stored formatting configuration information, mapping the parsed phrases to respective ones of the vocabulary domains and providing each parsed phrase to a corresponding limited vocabulary domain server capable of converting the parsed phrase to an audio component;

(iii) receiving audio components from the limited vocabulary domain servers, the audio component resulting from the conversion of the parsed phrases by the limited vocabulary domain servers; and (iv) generating audio to the user based on the audio components received from the limited vocabulary domain servers.

6. A system according to claim 5, wherein the content-based closeness metric shared by the textual information of each limited vocabulary domain includes sharing one or more selected words.

7. A system according to claim 5, wherein the second operation performed by the text-to-speech converter apparatus further includes:

maintaining a cache of the audio components from the limited vocabulary domain servers; and prior to providing the parsed phrases to the limited vocabulary domain servers, checking whether audio components for the parsed phrases are present in the cache;

and wherein (i) a given parsed phrase is provided to the corresponding limited vocabulary domain server only if the audio component for the given parsed phrase is not present in the cache, and (ii) the audio is generated to the user based on the audio components from the cache if present therein.

8. A system according to claim 5, wherein the text-based web site includes special audio components to be made available to users satisfying a predetermined criteria, and wherein the second operation performed by the text-to-speech converter apparatus further includes:

determining whether the user satisfies the predetermined criteria; and if the user is determined to satisfy the predetermined criteria, then retrieving the special audio components and generating special audio to the user based on the retrieved audio components.

* * * * *